US006676208B2

(12) United States Patent
Lu

(10) Patent No.: US 6,676,208 B2
(45) Date of Patent: Jan. 13, 2004

(54) COMBINED CHAIR AND OBJECT SUPPORT

(75) Inventor: Kun-Chung Lu, No. 9, Lane 728, Chi-Nan Road, Nan-Tze District, Kaohsiung (TW)

(73) Assignee: Kun-Chung Lu, Kaohsiung (TW)

( * ) Notice: Subject to any disclaimer, the term of this patent is extended or adjusted under 35 U.S.C. 154(b) by 0 days.

(21) Appl. No.: 10/159,698

(22) Filed: May 29, 2002

(65) Prior Publication Data

US 2003/0222486 A1 Dec. 4, 2003

(51) Int. Cl.[7] ..... A47C 4/00

(52) U.S. Cl. ..... 297/188.2; 297/188.1; 297/170; 297/16.1; 297/217.1

(58) Field of Search ..... 297/172, 173, 297/174 R, 156, 451.2, 338, 344, 16.2, 188.2, 183.5, 42, 188.1, 452.4, 452.2, 217.1; 248/282.1, 283.1, 127, 176, 146, 154, 149; 108/38, 115

(56) References Cited

U.S. PATENT DOCUMENTS

| | | | | | |
|---|---|---|---|---|---|
| 111,858 | A | * | 2/1871 | McCausland et al. | 108/28 |
| 1,859,320 | A | * | 5/1932 | Wetmore | 108/115 |
| 2,375,696 | A | * | 5/1945 | Shick | 297/423.19 |
| 2,550,415 | A | * | 4/1951 | Kammermeyer | 248/183.1 |
| 2,569,310 | A | * | 9/1951 | Hltt | 118/31.5 |
| 3,145,966 | A | * | 8/1964 | Landon | 248/464 |
| 4,134,614 | A | * | 1/1979 | Fielding, Sr. | 297/156 |
| 4,266,748 | A | * | 5/1981 | Dalton | 248/425 |
| 4,632,410 | A | * | 12/1986 | Bainbridge et al. | 280/32.5 |
| 4,767,159 | A | * | 8/1988 | Opsvik | 297/423.11 |
| 4,810,029 | A | * | 3/1989 | Kaladis et al. | 297/16.2 |
| 5,052,308 | A | * | 10/1991 | Brown | 108/118 |
| 5,524,968 | A | * | 6/1996 | Stoltz | 297/344.21 |
| 5,653,499 | A | * | 8/1997 | Goodall | 297/170 |
| 5,688,024 | A | * | 11/1997 | Arizpe-Gilmore | 297/217.1 |
| 5,711,572 | A | * | 1/1998 | Khan | 297/140 |
| 5,803,417 | A | * | 9/1998 | McNamara et al. | 248/149 |
| 5,816,648 | A | * | 10/1998 | Baccili et al. | 297/159.1 |
| 5,820,208 | A | * | 10/1998 | Miklinevich | 297/159.1 |
| 6,010,186 | A | * | 1/2000 | Tsay | 297/159.1 |
| 6,033,014 | A | * | 3/2000 | Nightengale | 297/174 R |
| 6,102,475 | A | * | 8/2000 | Hamann | 297/172 |
| 6,122,776 | A | * | 9/2000 | Cheng | 4/578.1 |
| 6,375,259 | B1 | * | 4/2002 | Ma | 297/217.3 |
| 6,405,660 | B2 | * | 6/2002 | Itakura et al. | 108/115 |
| 6,450,161 | B1 | * | 9/2002 | Izumi | 126/9 R |

* cited by examiner

*Primary Examiner*—Peter M. Cuomo
*Assistant Examiner*—Stephen D'Adamo
(74) *Attorney, Agent, or Firm*—Merchant & Gould, P.C.

(57) ABSTRACT

A combined chair and object support for video equipment, telescopes, drawing boards and the like, includes a chair leg assembly, a seat member, an upright support post and a linking member. The chair leg assembly has an upper leg end, and a lower leg end opposite to the upper leg end and adapted to be placed on a ground surface. The seat member is mounted on the upper leg end of the chair leg assembly. The upright support post is adapted for mounting an object removably thereon. The linking member is formed with a first coupling end connected to the seat member, and a second coupling end connected to the support post, thereby forming a horizontal spacing between the seat member and the support post in a longitudinal direction.

19 Claims, 6 Drawing Sheets

COMBINED CHAIR AND OBJECT SUPPORT

BACKGROUND OF THE INVENTION

1. Field of the Invention

This invention relates to a support for objects, more particularly to a combined chair and object support for video equipment, telescopes, drawing boards and the like.

2. Description of the Related Art

Stands for supporting a variety of objects, such as cameras, telescopes, drawing boards and the like, are known in the art. However, the conventional stands are not equipped with means for sitting of the user, and thus require the use of a separate chair.

SUMMARY OF THE INVENTION

Therefore, the object of the present invention is to provide a combined chair and object support for video equipment, telescopes, drawing boards and the like to overcome the aforementioned drawback of the prior art.

According to this invention, a combined chair and object support includes a chair leg assembly, a seat member, an upright support post and a linking member. The chair leg assembly has an upper leg end, and a lower leg end opposite to the upper leg end and adapted to be placed on a ground surface. The seat member is mounted on the upper leg end of the chair leg assembly. The upright support post is adapted for mounting an object removably thereon. The linking member is formed with a first coupling end connected to the seat member, and a second coupling end connected to the support post, thereby forming a horizontal spacing between the seat member and the support post in a longitudinal direction.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
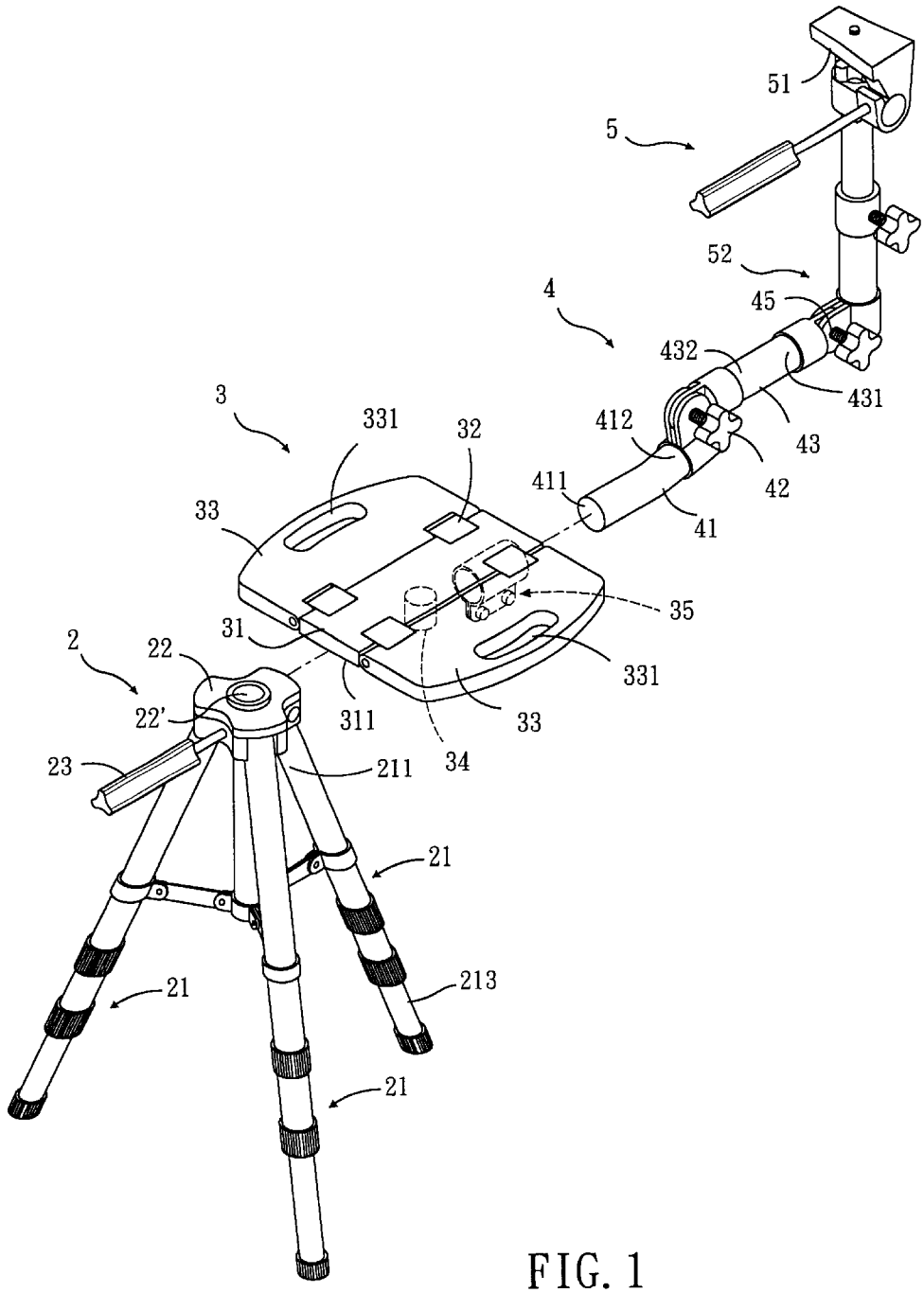
FIG. 1 is an exploded perspective view of the first preferred embodiment of a combined chair and object support according to the present invention.

Before the present invention is described in greater detail, it should be noted that same reference numerals have been used to denote like elements throughout the specification.

Figure 2:
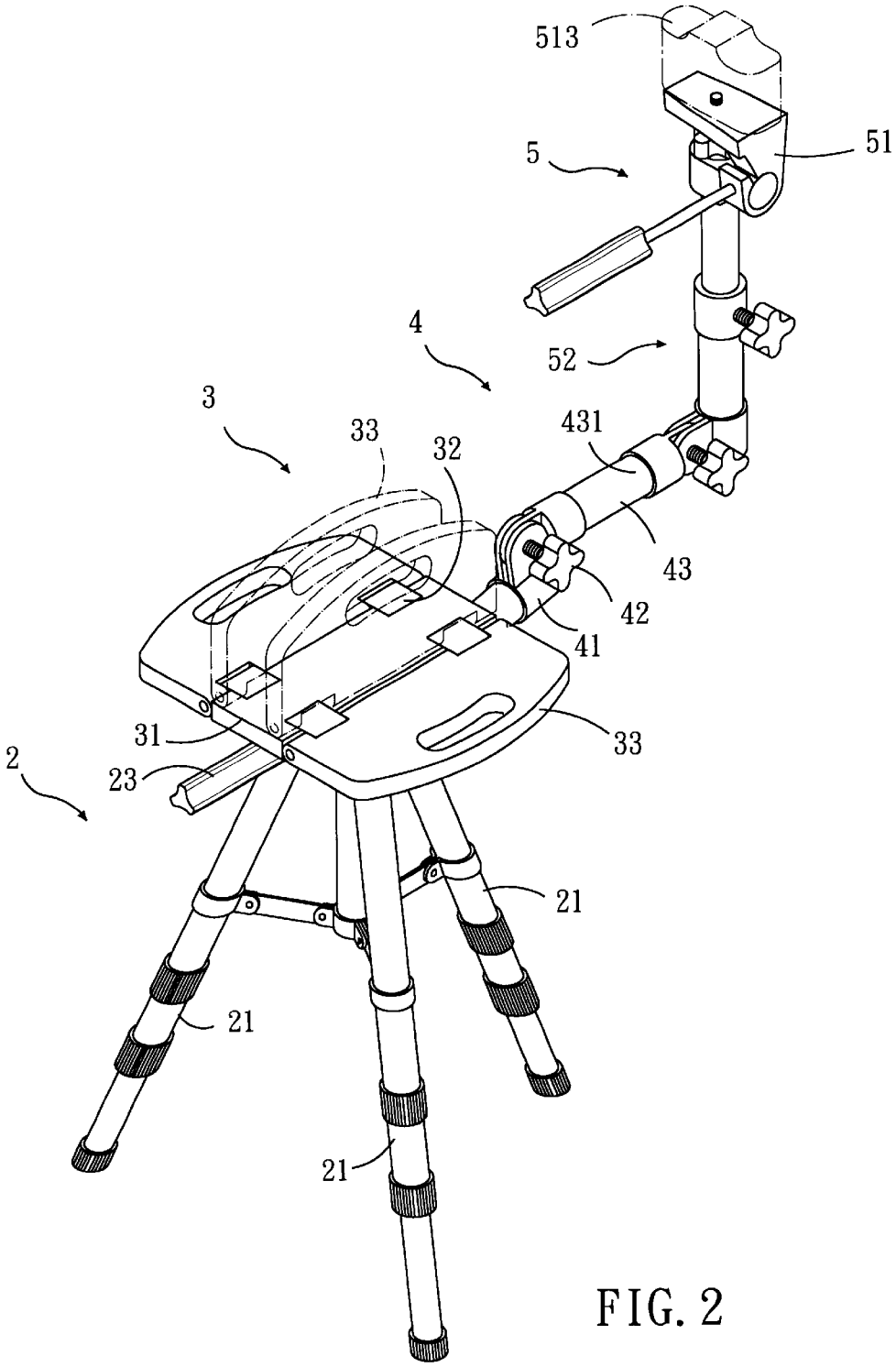
FIG. 2 is an assembled perspective view of the first preferred embodiment illustrating how wing plate portions of a seat member can be folded relative to a central plate portion.
Figure 3:
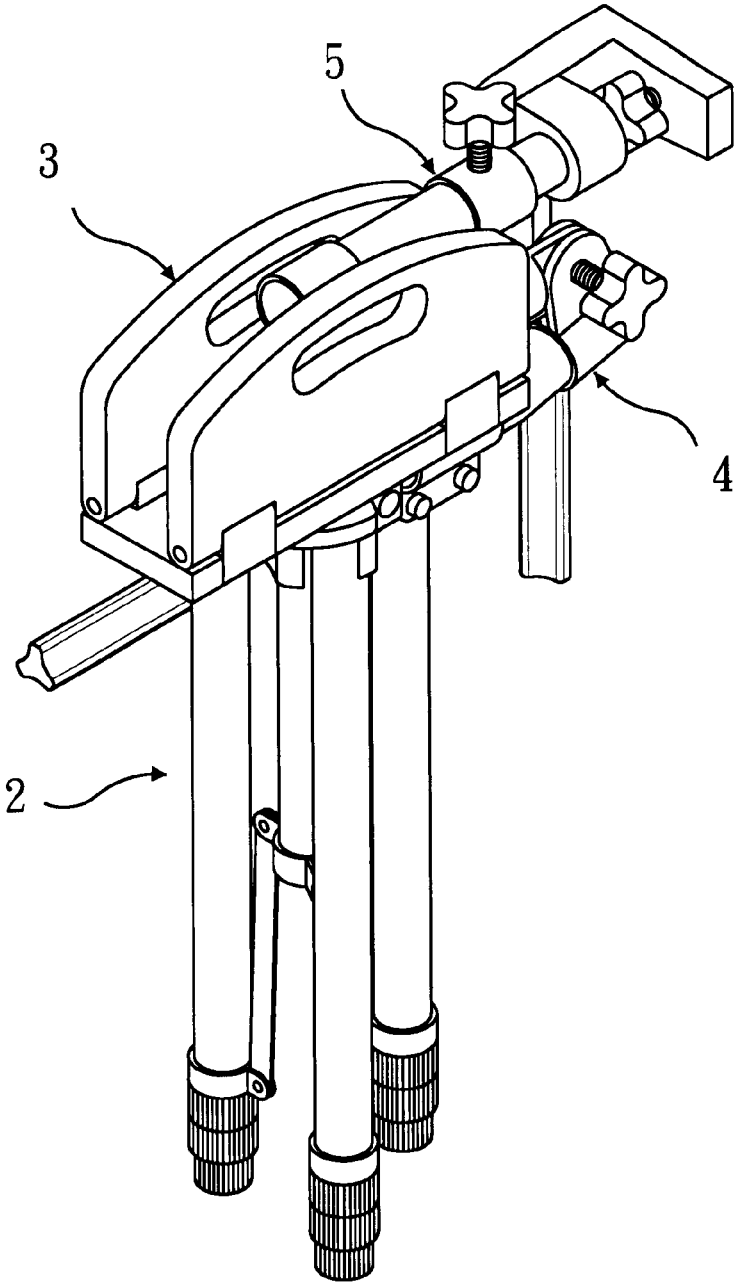
FIG. 3 is a perspective view showing the first preferred embodiment in a folded state.

Referring to FIGS. 1, 2 and 3, the first preferred embodiment of a combined chair and object support according to the present invention is shown to comprise a chair leg assembly 2, a seat member 3, an upright support post 5 and a linking member 4.

As illustrated, the chair leg assembly 2 has an upper leg end 211, and a lower leg end 213 opposite to the upper leg end 211 and adapted to be placed on a ground surface. The seat member 3 is mounted on the upper leg end 211 of the chair leg assembly 2. The upright support post 5 is adapted for mounting an object, such as a camera 513 (see FIG. 2), removably thereon. The linking member 4 has a first coupling end 411 connected to the seat member 3, and a second coupling end 431 connected to the support post 5, thereby forming a horizontal spacing between the seat member 3 and the support post 5 in a longitudinal direction, as best shown in FIG. 2.

The chair leg assembly 2 includes a plurality of known telescopic legs 21. The chair leg assembly 2 further includes a coupler 22 at the upper leg end 211. The telescopic legs 21 are connected pivotally to the coupler 22, thereby permitting folding of the chair leg assembly 2. The seat member 3 has a bottom side 311 formed with a connecting post 34. The coupler 22 has a vertical coupling hole 22' for receiving the connecting post 34, such that the seat member 3 can be mounted on the chair leg assembly 2. Preferably, the coupler 22 of the chair leg assembly 2 is provided with a retaining unit in the form of a threaded rod 23 for retaining removably the connecting post 34 in the coupling hole 22'.

A known clamp 35 is mounted on the bottom side 311 of the seat member 3. The first coupling end 411 of the linking member 4 is clamped by the clamp 35 to mount removably the first coupling end 411 to the seat member 3.

The linking member 4 includes a first link 41, a second link 43, and a first angle-adjustable joint 42. The first link 41 is formed with the first coupling end 411 and a first pivot end 412 opposite to the first coupling end 411. The second link 43 is formed with the second coupling end 431 and a second pivot end 432 opposite to the second coupling end 431. The first angle-adjustable joint 42 is a conventional device that interconnects the first and second pivot ends 412, 432 to retain the second link 43 at a desired angle relative to the first link 41.

The linking member 4 further includes a second angle adjustable joint 45 similar to the first angle-adjustable joint 42, provided at the second coupling end 431, and connected to the support post 5 to retain the support post 5 at a desired angle relative to the second link 43.

The seat member 3 includes a central plate portion 31 formed with the connecting post 34 and mounted with the clamp 35, and a pair of wing plate portions 33 connected foldably and respectively to opposite lateral sides of the central plate portion 31. The first and second links 41, 43 and the support post 5 are foldable so as to be disposed on top of the central plate portion 31. The wing plate portions 33 are foldable upwardly relative to the central plate portion 31 when the first and second links 41, 43 and the support post 5 are folded on the central plate portion 31, as best shown in FIG. 3.

Preferably, each of the wing plate portions 33 is formed with a grip hole 331 to facilitate upward folding of the wing plate portions 331 relative to the central plate portion 31.

In this embodiment, the support post 5 includes a telescopic post 52 having an upper end provided with a known mounting device 51 for mounting the object removably and adjustably thereon.

Figure 4:
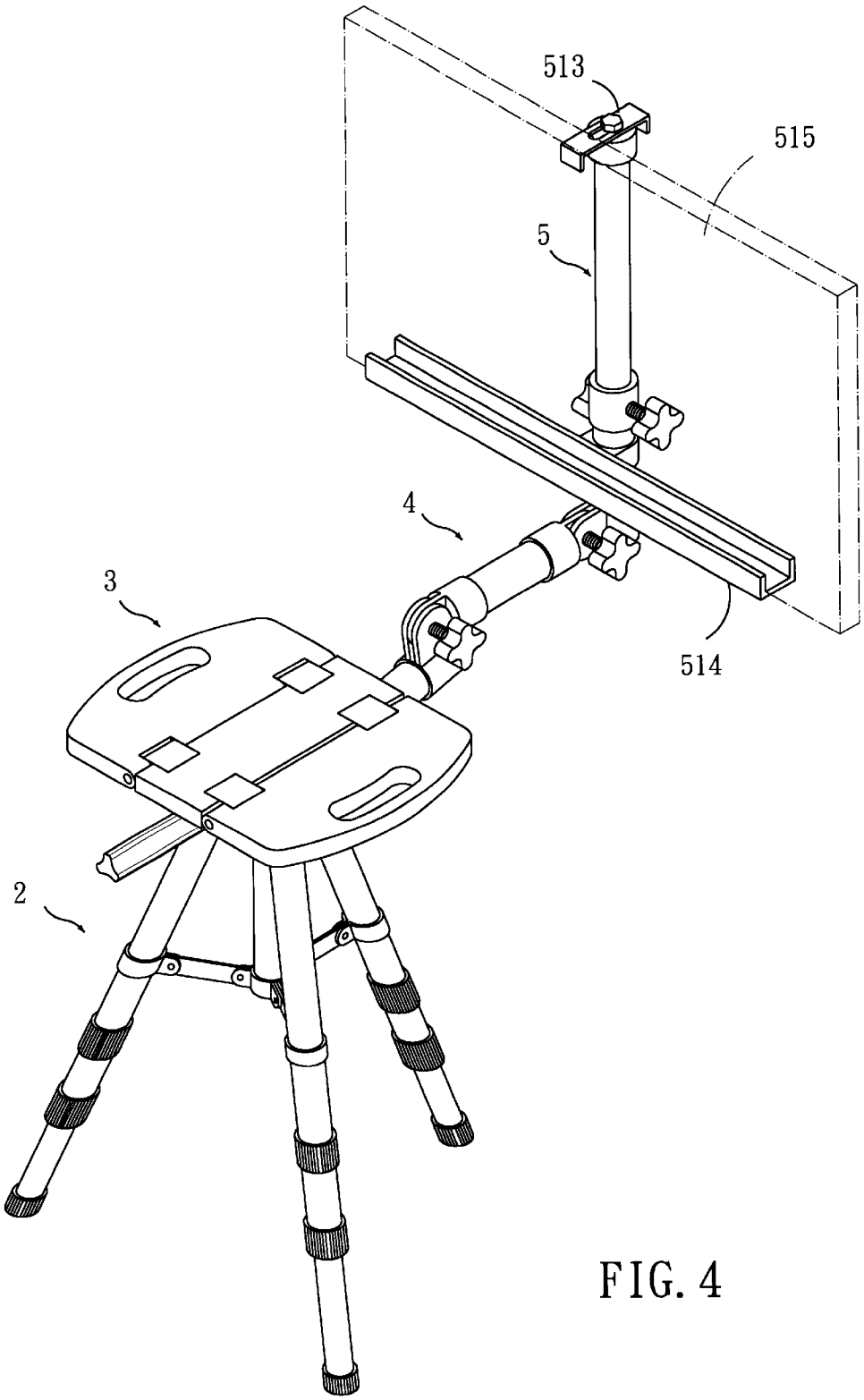
FIG. 4 is a perspective view of the second preferred embodiment of a combined chair and object support according to the present invention.
Figure 5:
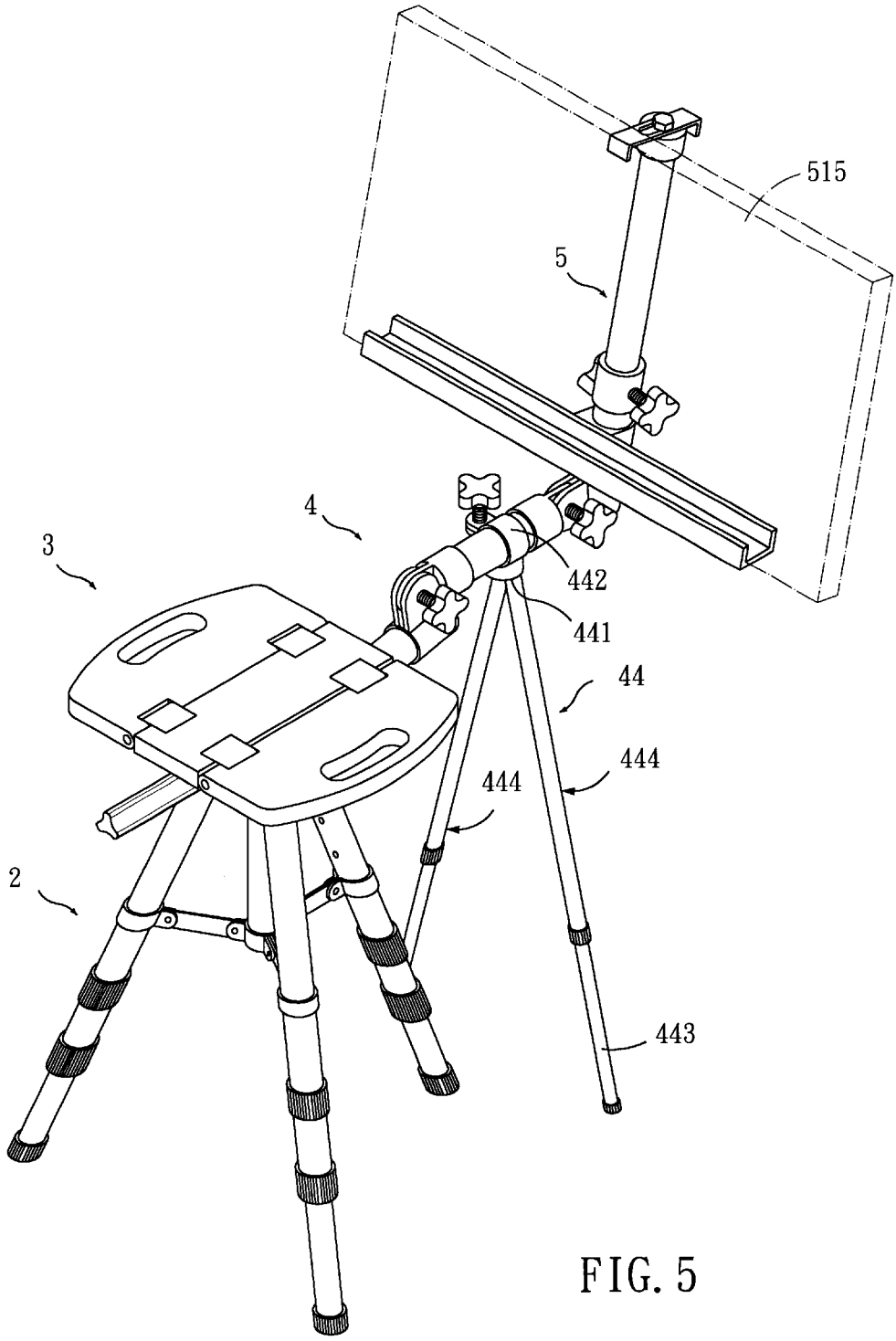
FIG. 5 is a perspective view of the third preferred embodiment of a combined chair and object support according to the present invention.

Referring to FIG. 4, in the second preferred embodiment of the present invention, the object mounted on the support post 5 is a bracket 513. A board rail 514 is supported by the linking member 4 in a transverse direction transverse to the longitudinal direction. The board rail 514 is adapted to cooperate with the bracket 513 to retain a drawing board 515 on the support post 5.

Referring to FIG. 4, in the third preferred embodiment of the present invention, the combined chair and object support further comprises an auxiliary leg unit 44 having an upper leg part 441 connected removably to the linking member 4 via a known clamp 442, and a lower leg part 443 opposite to the upper leg part 441 and adapted to be placed on the ground surface. The auxiliary leg unit 44 includes a pair of telescopic rods 444. Thus, the drawing board 515 can be stably supported on the ground surface.

Figure 6:
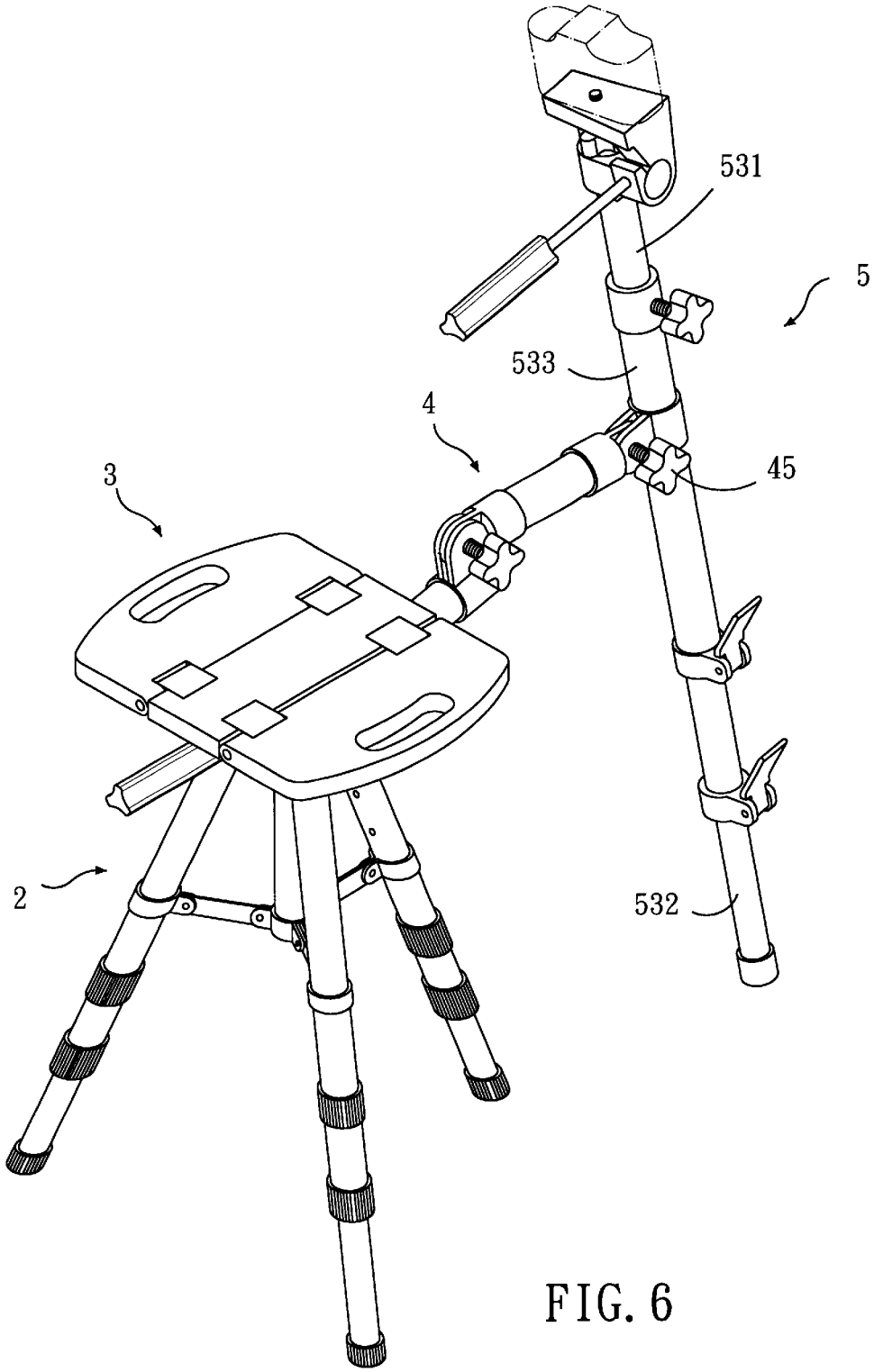
FIG. 6 is a perspective view of the fourth preferred embodiment of a combined chair and object support according to the present invention.

Referring to FIG. 6, in the fourth preferred embodiment of the present invention, the support post 5 is in the form of a telescopic post having an upper post end 531 adapted to be mounted with the object, a lower post end 532 adapted to be placed on the ground surface, and a middle post section 533 between the upper and lower post ends 531, 532 and connected to the second angle adjustable joint 45 of the linking member 4.

In view of the configuration of the combined chair and object support, the user need not stand when the present invention is in use.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A combined chair and object support comprising:

a chair leg assembly having an upper leg end, and a lower leg end opposite to said upper leg end and adapted to be placed on a ground surface;

a seat member mounted on said upper leg end of said chair leg assembly;

an upright support post adapted for mounting an object removably thereon; and a linking member having a first coupling end connected to said seat member, and a second coupling end connected to said support post, thereby forming a horizontal spacing between said seat member and said support post in a longitudinal direction, wherein the object mounted on said support post being a bracket, further comprising a board rail supported by said linking member in a transverse direction transverse to the longitudinal direction, said board rail being adapted to cooperate with the bracket to retain a drawing board on said support post.

2. The combined chair and object support as claimed in claim 1, wherein said seat member has a bottom side and a clamp mounted on said bottom side, said first coupling end of said linking member being clamped by said clamp to mount removably said first coupling end to said seat member.

3. The combined chair and object support as claimed in claim 1, wherein said support post is a telescopic post.

4. The combined chair and object support as claimed in claim 1, wherein said support post has an upper end provided with a mounting device for mounting the object removably and adjustably thereon.

5. The combined chair and object support as claimed in claim 1, wherein said linking member includes:

a first link formed with said first coupling end and a first pivot end opposite to said first coupling end;

a second link formed with said second coupling end and a second pivot end opposite to said second coupling end; and a first angle-adjustable joint interconnecting said first and second pivot ends to retain said second link at a desired angle relative to said first link.

6. The combined chair and object support as claimed in claim 5, wherein said linking member further includes a second angle adjustable joint provided at said second coupling end and connected to said support post to retain said support post at a desired angle relative to said second link.

7. The combined chair and object support as claimed in claim 6, wherein said seat member includes a central plate portion and a pair of wing plate portions connected foldably and respectively to opposite lateral sides of said central plate portion, said first and second links and said support post being foldable so as to be disposed on top of said central plate portion, said wing plate portions being foldable upwardly relative to said central plate portion when said first and second links and said support post are folded on said central plate portion.

8. The combined chair and object support as claimed in claim 7, wherein each of said wing plate portions is formed with a grip hole to facilitate upward folding of said wing plate portions relative to said central plate portion.

9. The combined chair and object support as claimed in claim 1, further comprising an auxiliary leg unit having an upper leg part connected removably to said linking member, and a lower leg part opposite to said upper leg part and adapted to be placed on the ground surface.

10. The combined chair and object support as claimed in claim 9, wherein said auxiliary leg unit includes a pair of telescopic rods.

11. The combined chair and object support as claimed in claim 1, wherein said chair leg assembly further includes a plurality of telescopic legs.

12. The combined chair and object support as claimed in claim 11, wherein said chair leg assembly further includes a coupler at said upper leg end, said telescopic legs being connected pivotally to said coupler.

13. The combined chair and object support as claimed in claim 12, wherein said seat member has a bottom side formed with a connecting post, said coupler being formed with a vertical coupling hole for receiving said connecting post, thereby mounting said seat member on said chair leg assembly.

14. The combined chair and object support as claimed in claim 13, further comprising a retaining unit for retaining removably said connecting post in said coupling hole.

15. The combined chair and object support as claimed in claim 12, wherein said seat member includes a central plate portion and a pair of wing plate portions connected foldably and respectively to opposite lateral sides of said central plate portion, said central plate portion being mounted removably on said coupler, said wing plate portions being foldable upwardly relative to said central plate portion.

16. The combined chair and object support as claimed in claim 15, wherein each of said wing plate portions is formed with a grip hole to facilitate upward folding of said wing plate portions relative to said central plate portion.

17. A combined chair and object support comprising:

a chair leg assembly having an upper leg end, and a lower leg end opposite to said upper leg end and adapted to be placed on a ground surface;

a seat member mounted on said upper leg end of said chair leg assembly;

an upright support post adapted for mounting an object removably thereon; and a linking member having a first coupling end connected to said seat member, and a second coupling end connected to said support post, thereby forming a horizontal spacing between said seat member and said support post in a longitudinal direction, wherein said chair leg assembly includes a plurality of telescopic legs, said chair leg assembly further includes a coupler at said upper leg end, said telescopic legs being connected pivotally to said coupler, said seat member includes a central plate portion and a pair of wing plate portions connected foldably and respectively to opposite lateral sides of said central plate portion, said central plate portion being mounted removably on said coupler, said wing plate portions being foldable upwardly relative to said central plate portion.

18. A combined chair and object support comprising:

a chair leg assembly having an upper leg end, and a lower leg end opposite to said upper leg end and adapted to be placed on a ground surface;

a seat member mounted on said upper leg end of said chair leg assembly;

an upright support post adapted for mounting an object removably thereon; and a linking member having a first coupling end connected to said seat member, and a second coupling end connected to said support post, thereby forming a horizontal spacing between said seat member and said support post in a longitudinal direction, wherein said linking member including a first link formed with said first coupling end and a first pivot end opposite to said first coupling end; a second link formed with said second coupling end and a second pivot end opposite to said second coupling end; and a first angle-adjustable joint interconnecting said first and second pivot ends to retain said second link at a desired angle relative to said first link;

said linking member further including a second angle adjustable joint provided at said second coupling end and connected to said support post to retain said support post at a desired angle relative to said second link; and said seat member including a central plate portion and a pair of wing plate portions connected foldably and respectively to opposite lateral sides of said central plate portion, said first and second links and said support post being foldable so as to be disposed on top of said central plate portion, said wing plate portions being foldable upwardly relative to said central plate portion when said first and second links and said support post are folded on said central plate portion.

19. A combined chair and object support comprising:

a chair leg assembly having an upper leg end, and a lower leg end opposite to said upper leg end and adapted to be placed on a ground surface;

a seat member mounted on said upper leg end of said chair leg assembly;

an upright support post adapted for mounting an object removably thereon;

a linking member having a first coupling end connected to said seat member, and a second coupling end connected to said support post, thereby forming a horizontal spacing between said seat member and said support post in a longitudinal direction; and further comprising an auxiliary leg unit having an upper leg part connected removably to said linking member, and a lower leg part opposite to said upper leg part and adapted to be placed on the ground surface.

* * * * *